United States Patent [19]

Gill

[11] 4,337,972

[45] Jul. 6, 1982

[54] PANEL BOARD SAFETY LATCH ASSEMBLY

[75] Inventor: Thomas E. Gill, St. Louis, Mo.

[73] Assignee: Killark Electric Manufacturing Co., St. Louis, Mo.

[21] Appl. No.: 87,652

[22] Filed: Oct. 24, 1979

[51] Int. Cl.[3] ..... E05C 5/02

[52] U.S. Cl. ..... 292/67; 292/DIG. 65; 200/50 A; 361/339

[58] Field of Search ..... 200/50 A; 361/344, 357, 361/347, 336; 292/67, DIG. 65

[56] References Cited

U.S. PATENT DOCUMENTS

| | | | |
|---|---|---|---|
| 3,760,132 | 9/1973 | Ellsworth et al. | 200/50 A |
| 3,796,922 | 3/1974 | Mrenna et al. | 200/50 A X |
| 3,978,304 | 8/1976 | Salvati et al. | 200/50 A X |
| 4,071,722 | 1/1978 | Hart | 361/339 |

*Primary Examiner*—Richard E. Moore

*Attorney, Agent, or Firm*—Rogers, Eilers & Howell

[57] ABSTRACT

A safety latch assembly for a circuit breaker panel board. The panel board includes a cabinet in which one or more circuit breakers are mounted behind a panel member, the breakers being operable between ON and OFF positions by an actuating member which in turn is operated by a handle mechanism mounted in the cover of the cabinet. The safety latch assembly includes a movable member operable in response to movement of the actuating member. The movable member has means engaging a portion of the handle mechanism preventing engagement of the actuating member by the handle mechanism, and thus preventing closing of the cabinet cover to which the handle mechanism is mounted, when the actuating member of the breaker is in the OFF position. Means are also provided for engaging the handle mechanism with the actuating member of the breaker in the ON position, preventing disengagement of the handle mechanism and the actuating member and removal of the cover.

8 Claims, 7 Drawing Figures

14
10
26
18
2
34
16

78
60
20
44
64
62
48
74
22
46
28

78
70
22
80
74
72
20

36
32
30
54
52
40
12
26
5
3
4
78
80
72
20
22
42
44
62
46
48
76
60
70
28
33
16
50
34

78
80
22
46
72
20
74
48
70
60
76
62
44
40
42
28
52
12
54
26
50
30
32
16
33
36
34

20
78
80
22
72
70
74
76
48
60
40
46
28
44
7
42
52
54
26
50
16
30
32

40
60
70
30
42
64
48
28
46
76
74
20
62
48
22
74

PANEL BOARD SAFETY LATCH ASSEMBLY

BACKGROUND AND SUMMARY OF THE INVENTION

This invention generally relates to a safety latch assembly for a panel board, and more particularly to a safety latch assembly for use with a circuit breaker panel board to prevent either the opening or closing of the panel cover when any of the breakers are in the ON position.

The panel board to which the present invention relates is of the type used in hazardous location, such as in the presence of flammable vapors, liquids or gases or combustible dusts, easily ignitable fibers or flyings, damp or wet locations, or the like.

While safety latch assemblies for panel boards are generally known in the art, they have certain disadvantages. Many are relatively complex and expensive and not easily adaptable to standard safety panel design, and they permit closing of the closure cover with the breaker in the ON position. This latter disadvantage can result in the breaker being ON with the external handle assembly for operating the breaker indicating that the breaker is in the OFF position resulting in a potentially hazardous condition.

Thus, it is a primary purpose of the present invention to provide a safety latch assembly that is relatively simple in construction, inexpensive, exceptionally reliable, and readily adaptable for use with existing safety breaker panels.

It is a particular objective of the invention to provide such a safety latch assembly that prohibits closing of the closure cover with the breaker in the ON position, and preferably prevents both closing and opening of the closure cover with the breaker in the ON position.

Generally, the panel board safety latch assembly of the present invention is used with a circuit breaker panel board including a cabinet or enclosure in which one or more circuit breakers are mounted behind a panel member. Typically, several such breakers are mounted in columns and each is operable between ON and OFF positions by an actuating member such as a toggle. A handle is mounted in the cover of the cabinet for operable engagement with the actuating member to operate same between its ON and OFF positions.

The safety latch assembly of the present invention includes a movable member operable in response to movement of the actuating member and which has means engaging a portion of the handle mechanism to prevent engagement of the actuating member by the handle mechanism, and thus closing of the cabinet cover, when the breaker is in the ON position. The safety latch assembly of the present invention also includes means engaging the handle mechanism when the actuating member is in the ON position preventing disengagement of the handle mechanism and actuating member, and thus opening or removal of the cover. A more detailed description follows.

DETAILED DESCRIPTION

Figure 1:
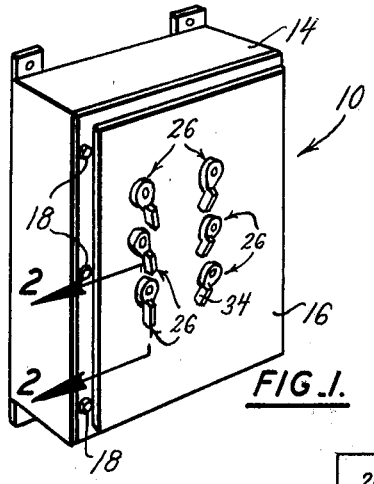
FIG. 1 is an isometric view of a panel board or cabinet for housing a plurality of circuit breakers, and incorporating a safety latch assembly of the present invention.

With reference to the drawing there is shown a circuit breaker panel board 10 incorporating a safety latch assembly 12 of the present invention. The panel board 10 includes a cabinet or enclosure 14 having side, top, bottom and back walls, and a removable cover 16 held closed by bolts 18 or the like. The cover may be hinged along one side.

Within the cabinet 14 is mounted one or more circuit breakers depicted generally by the numeral 20 and which may be of any suitable type operated between ON and OFF positions by an actuating member such as a toggle 22. By way of example only, the circuit breaker may be a square "D" type EH or EHB circuit breaker. Typically, there are several such circuit breakers mounted in columns within the cabinet, each operable between ON and OFF positions by means of the actuating member 22.

As previously stated, the panel board 10 is for use in hazardous locations so that although the entire breaker including its actuating member 22 is located within the cabinet 14, provision is made for operating the actuating member with the cover 16 closed. This is accomplished, in part, by means of a handle mechanism 26 mounted in the cover 16 and having a portion 28 engaging the actuating member 22 to operate same between On and OFF positions upon turning of the handle.

Figure 2:
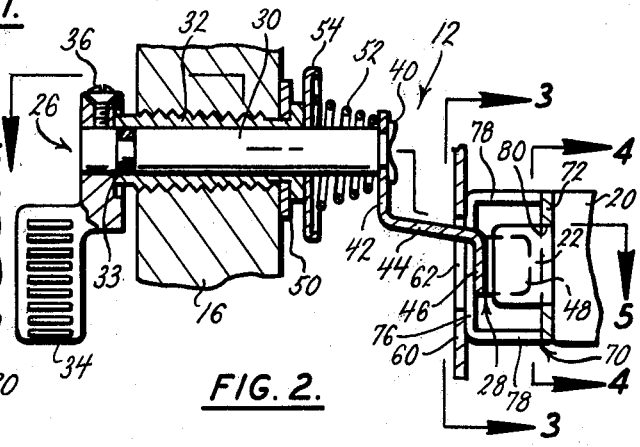
FIG. 2 is an enlarged view in section taken generally along the line 2—2 of FIG. 1.
Figure 5:
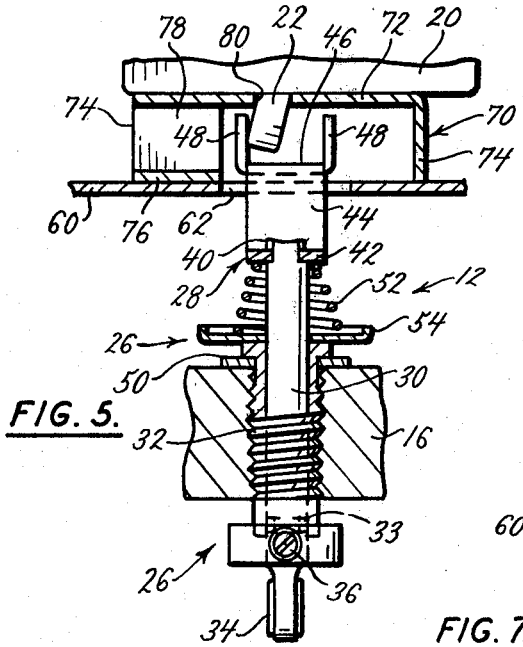
FIG. 5 is a view in section taken generally along the line 5—5 of FIG. 2 and showing the breaker in the OFF position.

Thus, the handle mechanism 26 includes a shaft 30 having an externally threaded sleeve 32 thereon and axially slidable on the shaft. An O-ring 33 is located in a recess near the outer end of the shaft between the shaft and sleeve. A handle 34 is secured to the outer end of the shaft 30 such as by means of a screw and lockwasher 36. The engaging portion 28 of the handle mechanism is mounted at the inner end of the shaft such as by means of a rivet type fit 40. The portion 28 generally comprises an offset bifurcated member which may be formed from a metal stamping. Thus, the portion 28 includes a vertical portion 42 secured to the inner end of the shaft, a portion 44 extending rearwardly therefrom, and a portion 46 extending downwardly (as shown in FIG. 2) at the inner end of the portion 44. Extending rearwardly from the portion 46 are ears 48 which form the bifurcation and which are positioned on opposite sides of the actuating member 22 to embrace same when the cover 16 is closed.

The handle mechanism is mounted in a threaded opening in the cover 16 by the threaded sleeve 32 and a lockwasher 50 (sleeve 32 is assembled from inside the cover). Between the inner end of the sleeve and the portion 28, are a compression spring 52 and spring retaining washer 54. The spring 52 insures positive engagement between the portion 28 of the handle mechanism and the actuating member 22 of the breaker when the cover is closed, and also prevents damage to parts when the cover is closed, if the handle 34 and the movable member to be described are not both in the OFF position.

Figure 3:
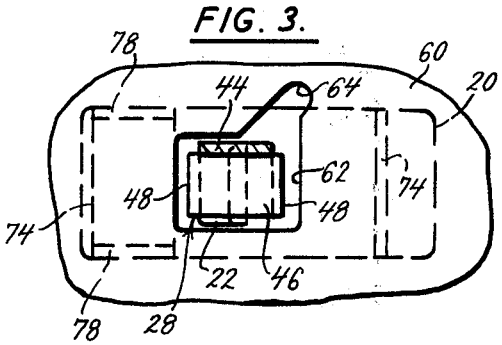
FIG. 3 is a view in section taken generally along the line 3—3 of FIG. 2.
Figure 4:
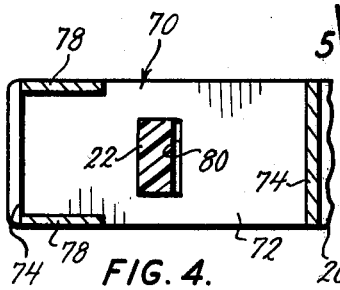
FIG. 4 is a view in section taken generally along the line 4—4 of FIG. 2.
Figure 6:
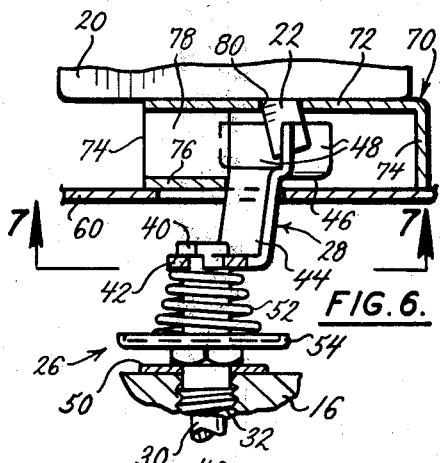
FIG. 6 is a view similar to that of FIG. 5 but showing the breaker in the ON position.
Figure 7:
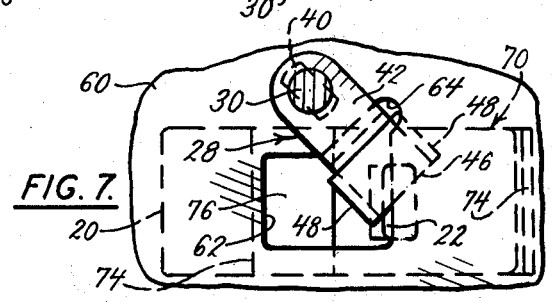
FIG. 7 is a view in section taken generally along the line 7—7 of FIG. 6.

Spaced forwardly of the breaker 20 and the actuating member 22 is a panel member or plate 60 having an opening 62 therein forwardly of the actuating member 22 through which the portion 28 of the handle mechanism extends when the cover 16 is closed. The opening 62 is shaped generally as shown in FIGS. 3 and 7 and may be described as being generally rectangular with an extended slot portion 64. The opening 62 is sized and positioned such that with the actuating member 22 in the OFF position (FIGS. 2 through 5), the actuator engaging portion 28 is permitted to move through the opening to either remove or replace the cover 16, but with the actuating member 22 in the ON position (FIGS. 6 and 7) a part of the portion 28, namely the part 46, is positioned behind the panel member 60 to prohibit withdrawal of the portion 28 through the opening, and thus prohibit the opening of the cover 16. The extended slot portion 64 acts as a relief to allow rotating movement of the handle mechanism between OFF and ON positions with the upper edge of the slot portion acting as a stop.

With the description thus far, it can be seen that while the engagement of the handle mechanism with the panel member prevents opening the cover 16 with the circuit breaker in the ON position, it would be possible to close the cover 16 with the breaker in the ON position by positioning the handle mechanism 26 in the OFF position and then closing the cover. Under these conditions, the bifurcated portion of the handle mechanism would pass through the opening 62 but would not lodge on either side of the actuating member 22. Instead, it would lodge entirely on the left side (as viewed in FIGS. 5, 6, and 7) of the actuating member. This would result in a potentially hazardous condition with the cover closed, the handle 26 indicating that the breaker is OFF, but the breaker actually being ON.

To prevent this potentially hazardous condition, and prohibit the closing of the door 16 unless the actuating member is in the OFF position, there is provided a movable member 70 which slides from side-to-side in response to operation of the actuating member 22 to effectively reduce the size of the opening 62 in the panel member 60 when the actuating member is in the ON position and prevent the passage therethrough of the bifurcated end of the handle mechanism upon attempting to close the door regardless of the position of the handle mechanism.

The movable member 70 has a back wall 72 and forwardly extending flanges defining end walls 74. Near one end of the member 70 is a forward wall or overhang 76 which is spaced forwardly of the rear wall by the end wall 74 and side walls 78. The back wall 72 has an opening 80 therein just wide enough to comfortably receive the actuating member 22 and permit it to rock between OFF and ON positions and also cause the movable member 70 to slide from side-to-side as the actuating member is operated by the handle mechanism. The actuating member 22 also serves to vertically position the movable member 70. It will be noted that the movable member 70 is positioned between the front surface of the circuit breaker and the panel member 60.

In the operation of the safety latch assembly of this invention, it will be noted that with the actuating member in the OFF position, the over-hang 76 is retracted so that the bifurcated end of the handle mechanism can freely pass through the opening 62 in the panel member and thus allow either removal or replacement of the cover. When the actuating member 22 is moved to the ON position through its engagement with the bifurcated portion and upon rotation of the handle to the position shown in FIGS. 6 and 7, the bifurcated portion is positioned behind the panel member to block the passage of the bifurcated portion through the opening 62 and thus prevent removal of the cover. If the cover is removed, and the actuating member 22 is placed in the ON position, it is not possible to replace the cover regardless of the position of the handle mechanism. This is caused by the fact that when the actuating member is moved to the ON position, the movable member 70 is caused to slide with the over-hang 76 overlying a portion of the opening 62 to effectively reduce the size of that opening sufficiently to prevent the passage of the bifurcated portion therethrough, and thus prevent closing of the cover 16. The safety latch assembly of the present invention prevents both opening and closing the cover with the circuit breaker in the ON position.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

What I claim is:

1. A safety latch assembly for a circuit breaker panel board, said panel board including a cabinet in which one or more circuit breakers are mounted behind a panel member, the breakers being operable between ON and OFF positions by an actuating member engaged by a handle mechanism mounted in the cover of the cabinet, said safety latch assembly comprising a movable member operable in response to movement of said actuating member, said movable member having means engaging said handle mechanism preventing engagement of said actuating member by said handle mechanism and the closing of the cabinet cover to which said handle mechanism is mounted when said actuating member is in the ON position.

2. The assembly of claim 1 further comprising means engaging said handle mechanism when said actuating member is in the ON position, preventing disengagement of said handle mechanism and said actuating member and removal of the cover to which the handle mechanism is mounted.

3. A safety latch assembly for a circuit breaker panel board, said panel board including a cabinet in which one or more circuit breakers are mounted behind a panel member, the breakers being operable between ON and OFF positions by an actuating member engaged by a handle mechanism mounted in the cover of the cabinet, said safety latch assembly comprising a movable member operable in response to movement of said actuating member, said movable member having means engaging said handle mechanism preventing engagement of said actuating member by said handle mechanism and the closing of the cabinet cover to which said handle mechanism is mounted when said actuating member is in the ON position, said safety latch assembly further comprising means engaging said handle mechanism when said actuating member is in the ON position, preventing disengagement of said handle mechanism and said actuating member and removal of the cover to which the handle mechanism is mounted and wherein said handle mechanism has a portion extending through an opening in said panel member to engage said actuating member, said movable member having a portion that overlies a portion of said opening with said movable member in one position preventing closing of said cover, and that retracts from its overlying position with said movable member in another position to allow closing of said cover.

4. The assembly of claim 3 wherein said movable member is positioned between said breaker and said panel member and slides between said positions in response to operation of said actuating member.

5. A safety latch assembly for a circuit breaker panel board, said panel board including a cabinet in which one or more circuit breakers are mounted behind a panel member, the breakers being operable between ON and OFF positions by an actuating member engaged by a handle mechanism mounted in the cover of the cabinet, said safety latch assembly comprising a sliding member positioned between said panel member and said breaker and having an opening sized to comfortably receive said actuating member to permit movement of said actuating member between ON and OFF positions and to slide said sliding member from side-to-side as the actuating member is moved, said handle mechanism having a portion engaging said actuating member to operate same between ON and OFF positions said panel member having an opening sized to permit passage therethrough of said engaging portion of said handle mechanism, when said actuating member is in the OFF position, permitting the closing and opening of said cover, and to permit the operation of said handle mechanism when engaged with said actuating member to operate said actuating member between OFF and ON positions, said sliding member having a portion that overlies a portion of the panel member opening, when the actuating member is in the ON position, to block passage through said panel opening of said portion of said handle mechanism in attempting to close the cover with the actuating member in the ON position and thus to prevent closure of the cover, and retracts from its overlying position with the actuating member in the OFF position to allow passage of said handle mechanism portion through said panel opening and thus allow closing of the cover.

6. The assembly of claim 5 wherein said panel opening is sized to provide engagement between said panel member and handle mechanism with the actuating member in the ON position preventing withdrawal of said handle mechanism portion through said panel member opening, and thus disengagement of said handle mechanism portion from said actuating member, upon attempted opening of said cover.

7. A safety latch assembly for a circuit breaker panel board, said panel board including a cabinet in which one or more circuit breakers are mounted behind a panel member, the breakers being operable between ON and OFF positions by an actuating member engaged by a handle mechanism mounted in the cover of the cabinet, said safety latch assembly comprising a movable member operable in response to movement of said handle mechanism between positions corresponding to ON and OFF positions of said breaker, said handle mechanism having a portion engaging said actuating member to operate same between said ON and OFF positions, said panel member having an opening sized to permit passage therethrough of said engaging portion of said handle mechanism with said actuating member in the OFF position, permitting the closing and opening of said cover, and to permit the operation of said handle mechanism when engaged with said actuating member to operate said actuating member between OFF and ON positions, and means associated with said movable member for effectively reducing the size of the panel member opening when the actuating member is in the ON position to block passage of said portion of said handle mechanism through said panel opening in attempting to close the cover with the actuating member in the ON position.

8. The assembly of claim 7 wherein said movable member is a sliding member having an over-hang, said over-hang overlying a portion of said panel opening when said actuating member is in the ON position to effectively reduce the size of said panel opening.

* * * * *